US006308878B1

(12) United States Patent
Stahlecker

(10) Patent No.: US 6,308,878 B1
(45) Date of Patent: Oct. 30, 2001

(54) TRANSPORTING BELT FOR TRANSPORTING A FIBER STRAND TO BE CONDENSED AND METHOD OF MAKING SAME

(75) Inventor: Hans Stahlecker, Haldenstrasse 20, 73079 Suessen (DE)

(73) Assignees: Fritz Stahlecker, Bad Uberkingen; Hans Stahlecker, Sussen, both of (DE)

( * ) Notice: Subject to any disclaimer, the term of this patent is extended or adjusted under 35 U.S.C. 154(b) by 0 days.

(21) Appl. No.: 09/361,525

(22) Filed: Jul. 27, 1999

(30) Foreign Application Priority Data

Aug. 17, 1998 (DE) ..... 198 37 182

(51) Int. Cl.[7] ..... B65H 20/00

(52) U.S. Cl. ..... 226/170; 226/95; 226/172; 19/236; 19/304

(58) Field of Search ..... 19/236, 237, 238, 19/239, 240, 241, 242, 243, 245, 247, 248, 249, 250, 252, 286, 287, 263, 304, 305, 307, 308, 150; 156/137, 138, 139, 143; 162/348, 358.2, 900, 903, 904; 226/95, 170, 172, 171

(56) References Cited

U.S. PATENT DOCUMENTS 3,851,681 * 12/1974 Egan ..... 139/420 R
3,915,202 * 10/1975 Curtis et al. ..... 139/425 A
4,290,170 * 9/1981 Brookstein et al. ..... 19/236
4,403,632 * 9/1983 Romanski et al. ..... 139/383 A
4,427,485 * 1/1984 Kutnyak et al. ..... 156/429
4,457,968 * 7/1984 Harvey ..... 442/189
4,784,190 * 11/1988 Mullaney ..... 139/383 A
5,562,968 * 10/1996 Fry .
5,571,590 * 11/1996 Schultz et al. ..... 56/73.2
5,584,101 * 12/1996 Brabant et al. ..... 19/304
5,600,872 * 2/1997 Artzt et al. .
5,700,356 * 12/1997 Lefkowitz ..... 162/358.1
5,714,041 * 2/1998 Ayers et al. ..... 162/111
5,843,258 * 12/1998 Murakami .
5,954,097 * 9/1999 Boutilier ..... 139/383 A
6,056,839 * 5/2000 Yu et al. ..... 156/137
6,073,314 * 6/2000 Barauke ..... 19/246
6,090,241 * 7/2000 Trokhan et al. ..... 162/109
6,103,067 * 8/2000 Stelljies, Jr. et al. .

FOREIGN PATENT DOCUMENTS

98/07925 * 2/1998 (WO) .

* cited by examiner

*Primary Examiner*—Donald P. Walsh
*Assistant Examiner*—Minh-Chau Pham
(74) *Attorney, Agent, or Firm*—Crowell & Moring LLP

(57) ABSTRACT

A transport belt for transporting a fiber strand to be condensed through a condensing zone of a ring spinning machine is provided with a perforation for an air suction stream which suctions the fiber strand. In at least one fiber strand transporting area, the perforation has at least 100 holes per square centimeter.

30 Claims, 4 Drawing Sheets

TRANSPORTING BELT FOR TRANSPORTING A FIBER STRAND TO BE CONDENSED AND METHOD OF MAKING SAME

BACKGROUND AND SUMMARY OF THE INVENTION

This application claims the priority of German application 198 37 182.9 filed in Germany of Aug. 17, 1998, the disclosure of which is expressly incorporated by reference herein.

The present invention relates to a transport belt for transporting a fiber strand to be condensed through a condensing zone, comprising a perforation for an air suction stream which suctions the fiber strand.

A transport of this type is known from the U.S. Pat. No. 5,600,872 as prior art. It is produced in the way of drafting aprons of spinning machines whereby for the purpose of suctioning the fiber strand, holes are arranged in one row in a fiber strand transport direction. The diameter of these holes corresponds to the width of the fiber strand to be condensed.

It is an object of the present invention to produce a transport belt of the above mentioned type, which is particularly favorably designed with regard to the condensing effect.

This object has been achieved in that in at least one fiber strand carrying area a perforation is present, which comprises at least 100 holes per square centimeter.

Such a large number of holes ensures a very even and thus homogenous air through-flow. It is not the size of the perforation which determines the degree of the condensing effect, but rather a suction slit arranged underneath the transport belt, and over which suction slit the transport belt slides. The finer the perforation, the better the condensing effect. For this reason, there are in further embodiments of the present invention at least 1000 holes per square centimeter provided. In especially preferred embodiments, in at least the area which carries the fiber strand through the condensing zone, the overall percentage of holes should amount to a total cross section of hole openings of at least 40% of the total strand carrying area.

The transport belt consists particularly advantageously of close-perforated woven filaments, in particular monofilaments. As a result of the weave, the perforation occurs so to speak by itself, without the holes having to be stamped out of a previously hole-free transport belt. Furthermore, by means of the degree of fineness of the filaments, the chosen number of holes per surface unit can be as high as is desired. The filaments chosen for the woven material have in addition the advantage that the edges can be reinforced by means of a heating process.

The production of the transport belt according to the present invention is possible in a variety of ways:

In one embodiment according to the present invention, an endless tube is woven, which is subsequently cut to size to fit the desired width of the transport belt. In another embodiment of the present invention, a woven fabric is produced in the desired width of the transport belt and subsequently welded to form an endless belt. It has been shown that the overlapping areas which arise from welding do not in any way impair the quality of the yarn. In a further embodiment it is provided that a belt strip is cut out of a larger surface and that the endless belt is then subsequently produced from this strip by means of welding. In particular in the case of the latter method, it is possible in a simple way to reinforce the lateral edges already during cutting, in that a heated cutting tool is used.

It can be favorable when the transport belt, made from woven filaments, comprises a stiffening skeleton, which can, for example be produced in that rougher filaments are woven in at certain intervals.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
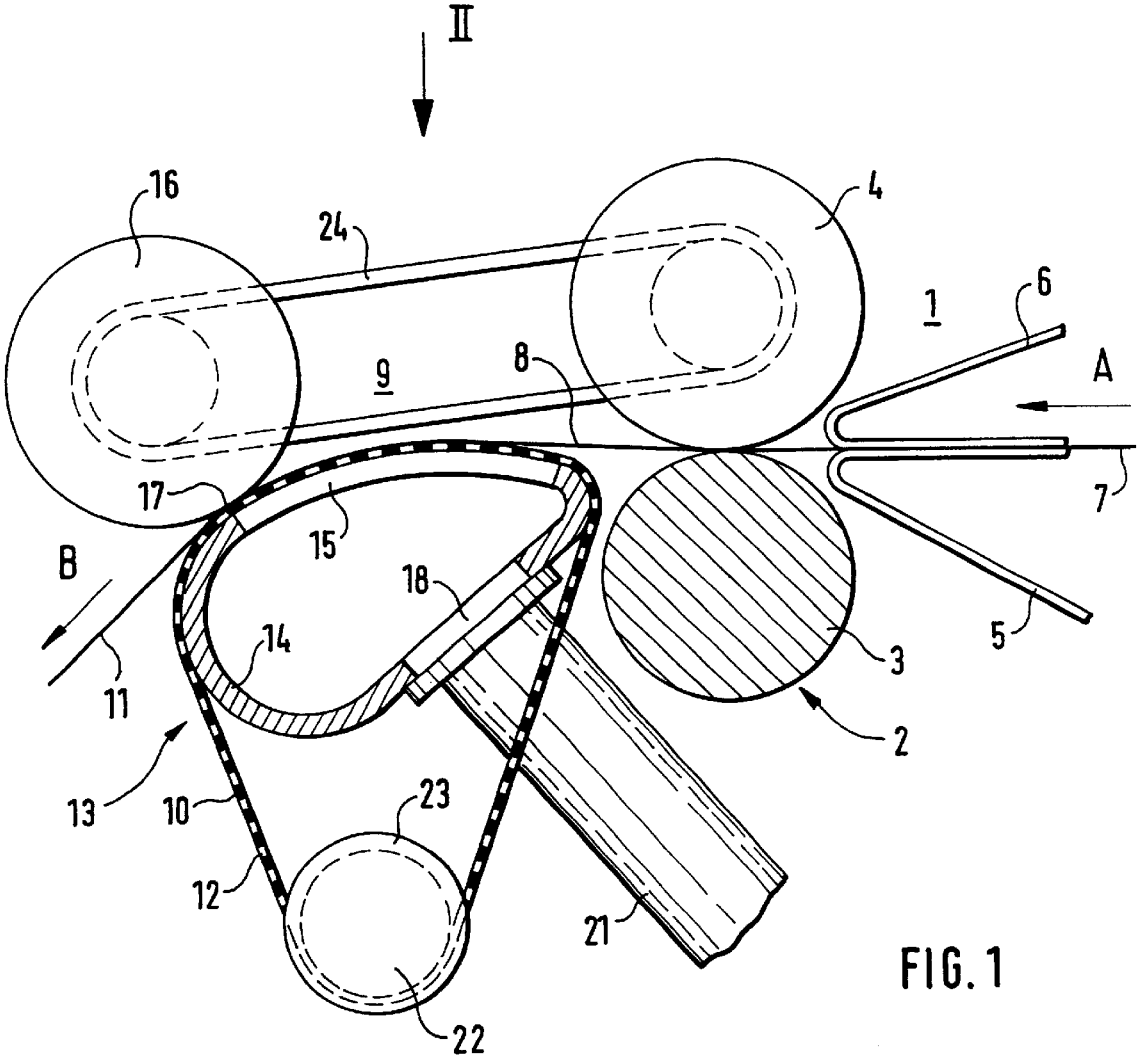
FIG. 1 is a partly sectional lateral view onto the area of a condensing zone, which is arranged downstream of a drafting arrangement of a ring spinning machine, constructed according to preferred embodiments of the present invention.
Figure 2:
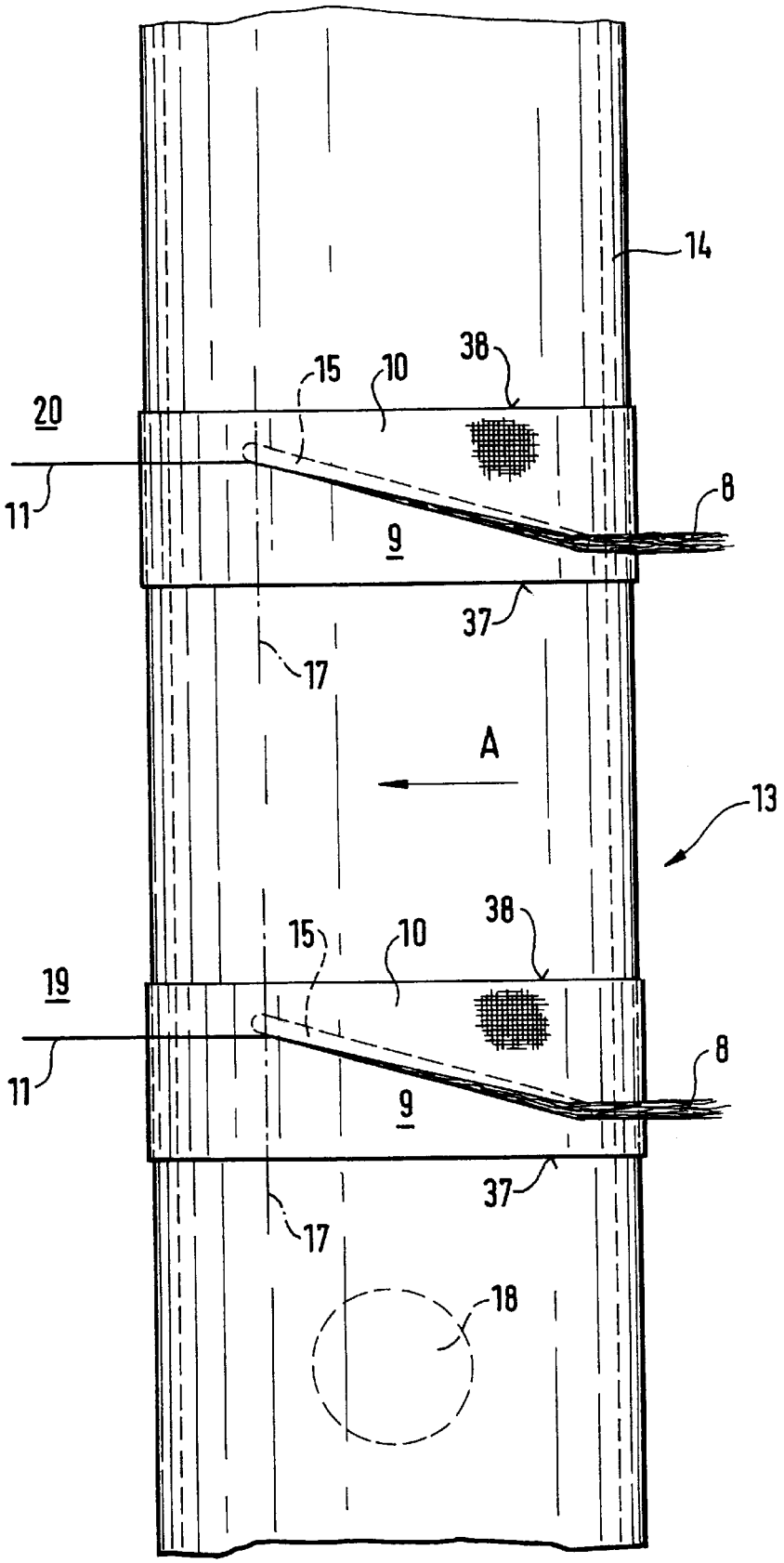
FIG. 2 is a view onto the condensing zone in the direction of the arrow 11 of FIG. 1, according to certain preferred embodiments of the present invention.

In FIGS. 1 and 2 the area of a ring spinning machine arranged downstream from a drafting arrangement 1 is shown. Of the drafting arrangement 1, only the front roller pair 2 as well as the bottom apron 5 and the top apron 6, arranged upstream in transport direction A, are shown. The front roller pair 2 comprises a driven bottom cylinder 3 extending in machine longitudinal direction, against which bottom cylinder 3 at each spinning station a top roller 4 is flexibly pressed.

In the drafting arrangement 1, a sliver or a roving 7 is drafted to the desired yarn count in a known way. Directly downstream of the front roller pair 2, a practically finished drafted fiber strand 8 exists, which receives at the most a slight subsequent draft in a condensing zone 9 arranged downstream. The condensing zone 9 serves to condense the drafted fiber strand 8 by means of fiber bundling, whereby outwardly projecting edge fibers are rolled in around the core strand. The fiber strand 8 is thus condensed in diameter, which results in an increased substance utilization and to a reduced hairiness of the thread 11 to be subsequently twisted, which thread 11 is fed in delivery direction B to a ring spindle (not shown).

The fiber strand 8 to be condensed is guided through the condensing zone 9 by means of a perforated transport belt 10. The transport belt 10 is preferably made of a close-perforated woven material, which due to its production is sufficiently air permeable. The perforation does not need to stretch over the entire effective width of the transport belt 10, but rather it is sufficient when the perforation is located in that area which is actually supporting the fiber strand 8.

The perforation consists of a plurality of holes 12, which arise of their own accord in the case of a woven material.

Due to the holes 12, the fiber strand 8 is suctioned to the transport belt 10 transporting it by means of a suction air stream, whereby it is important that this suction air stream is particularly homogenous. The transport belt 10 slides hereby over a suction device 13, which is advantageously formed as a hollow profile 14, which extends over a plurality of spinning stations 19, 20 . . . . The outer contour of the hollow profile 14 takes the form of a sliding surface for the transport belt 10.

The hollow profile 14 comprises per spinning station 19, 20 . . . a suction slit 15, over which the transport belt 10 with the fiber strand 8 is guided. The length of the suction slit 15 should reach to the end of the condensing zone 9, namely to a nipping line 17 which is effective as a twist block. The width of the suction slit 15 should be wider than the fiber strand 8 to be condensed, whereby a width of 1.5 mm has been shown to be favorable. The suction slit 15 is further disposed diagonally in transport direction A to a small degree, namely around 20°, so that the fiber strand 8 to be condensed is imparted a false twist in the condensing zone 9.

The twist block is effected by means of the nipping roller 16, which presses the transport belt 10 to the suction device 13 along the nipping line 17. It is important, that the twist running from the ring spindle and introduced into the yarn 11 does not reach into the condensing zone 9.

A suction opening 18 per machine section is located on the side of the hollow profile 14 facing away from the individual suction slits 15, from which suction opening 18 a suction pipe 21 leads to a vacuum source (not shown).

The transport belt 10 extends over a tension pulley 22, which is provided with lateral rims 23 for the purpose of the lateral guiding of the transport belt 10. In order that this lateral guiding is possible in the case of a woven material, the lateral edges 37 and 38 of the transport belt 10 are reinforced, for example by means of welding of the woven material consisting of polyamide filaments.

The nipping roller 16 is driven by the top roller 4, in the present case by means of a drive means 24, which takes the form of a belt or apron. The translation is so chosen that the peripheral speed of the nipping roller 16 is slightly greater than the peripheral speed of the front roller pair 2 of the drafting arrangement 1. By means thereof, the necessary tension draft is generated, which can, if required, be so great that a slight remaining post-draft remains in the yarn 11.

The percentage overall of the area of the holes in the transport belt 10 should amount, at least in that area which carries the fiber strand 8, to at least 40% of the total of that area. According to the present invention, the transport belt 10 has at least 100 holes per square centimeter, preferably even significantly more than 1000 holes per square centimeter. This results in a particularly homogenous suction air stream and inevitably to a very thin woven material, which is disposed on the suction slit 15 at practically no distance thereto. The suction air streaming through is thus therefore almost entirely "effective air."

Figures 3, 4, 5:
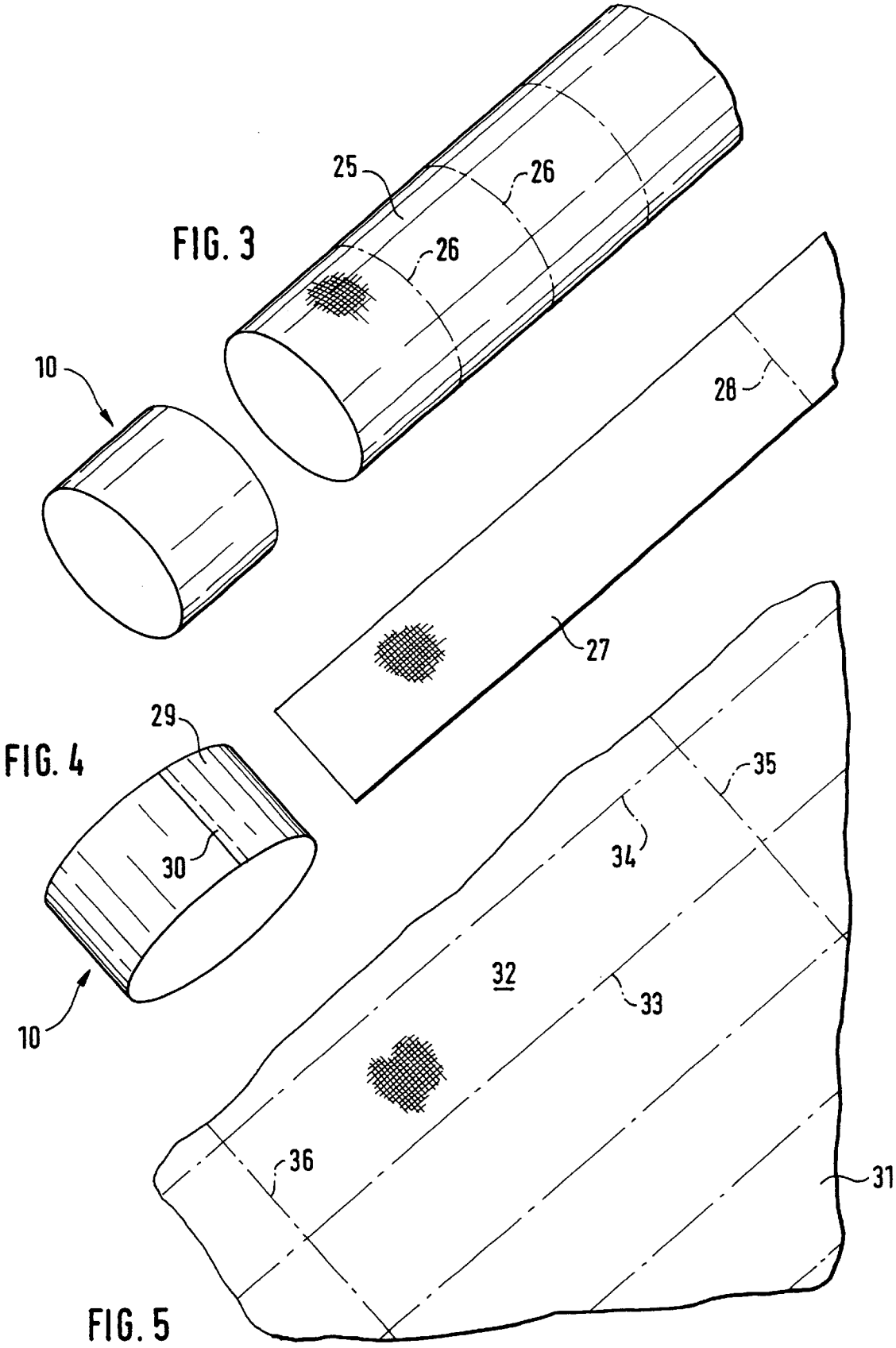
FIG. 3 is a schematic, perspective depiction of the production of a transport belt from an endless woven tube, according to certain preferred embodiments of the present invention.
FIG. 4 is a schematic, perspective depiction of the production of a transport belt from a woven fabric of preset width, according to further preferred embodiments of the present invention.
FIG. 5 is a schematic depiction of the production of a transport belt from a larger woven surface, according to further preferred embodiments of the present invention.

It can be seen from FIG. 3 that the transport belt 10 can be produced from an endless woven tube 25. This tube 25 is cut to size along cutting surfaces 26 to the desired width of the transport belt 10.

Alternatively, as in FIG. 4, a woven fabric 27 can be made having a preset width of the transport belt 10 and cut to length along cutting surfaces 28. There is then in the completed transport belt 10 along these cutting surfaces 28 a welded overlapping point 30. It has been shown that these overlapping points 30 do not impair the quality of the yarn.

A further process for producing a transport belt 10 is denoted in FIG. 5. Here, a plurality of belt strips 32 are cut out of a larger woven surface 31 along imaginary lateral edges 33 and 34 as well as end edges 35 and 36. Each belt strip 32 is then welded to form an endless transport belt 10, whereby an overlapping point also arises. A heated cutting tool can be used for cutting along the lateral edges 33 and 34, so that already during cutting, the desired lateral stiffness occurs.

Figure 6:
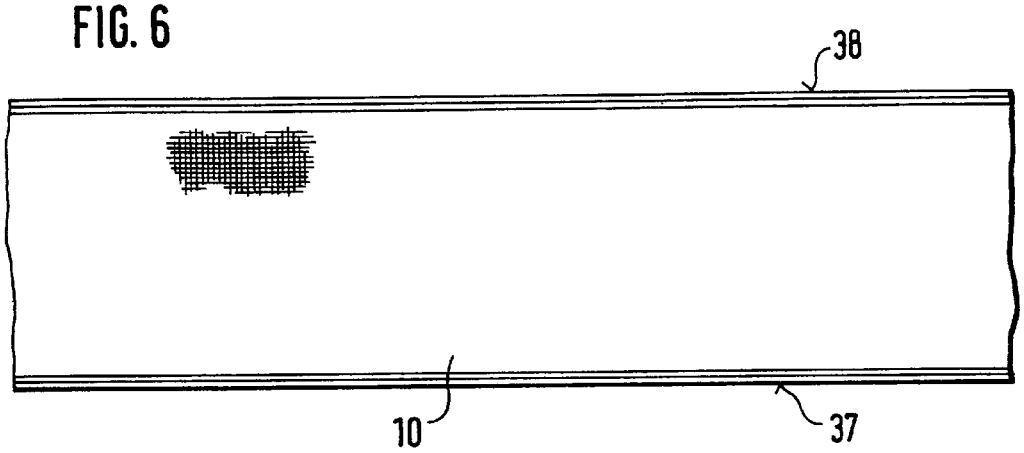
FIGS. 6 to 8 are top views of transport belts having reinforced areas in accordance with preferred embodiments of the present invention.

A top view of a part of the transport belt 10 is shown in FIG. 6, which transport belt 10 has the reinforced lateral edges 37 and 38 as described above. This reinforcement can be aided by means of rougher filaments in the edge areas, while the area supporting the fiber strand 8 consists of finer filaments.

Figure 7:
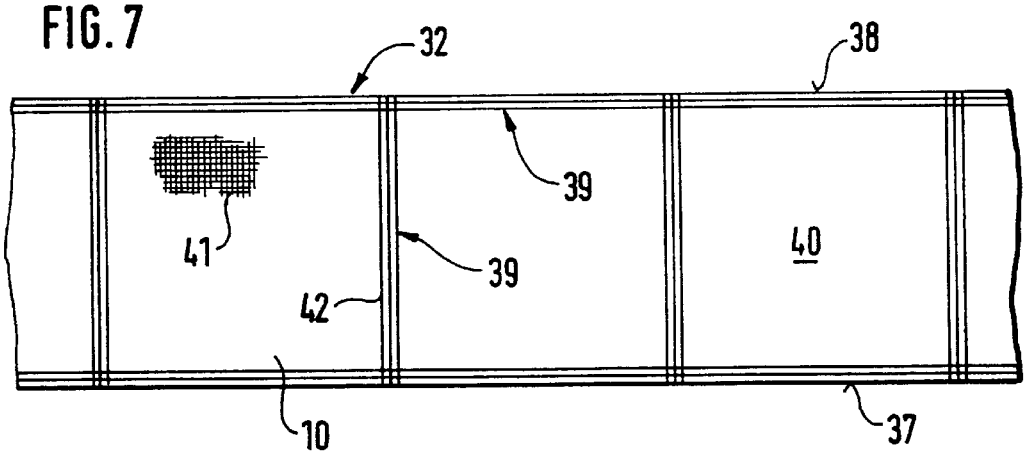

According to FIG. 7, the transport belt 10 is provided with a skeleton 39 which serves as a reinforcement. The skeleton 39 can be generated in that in the areas of the lateral edges 37 and 38 as well as at certain intervals in transverse direction, rougher filaments 42 are woven in. In the fields located between the rougher filaments 42, finer filaments 41 are woven in such a way that the desired fine perforation arises.

Figure 8:
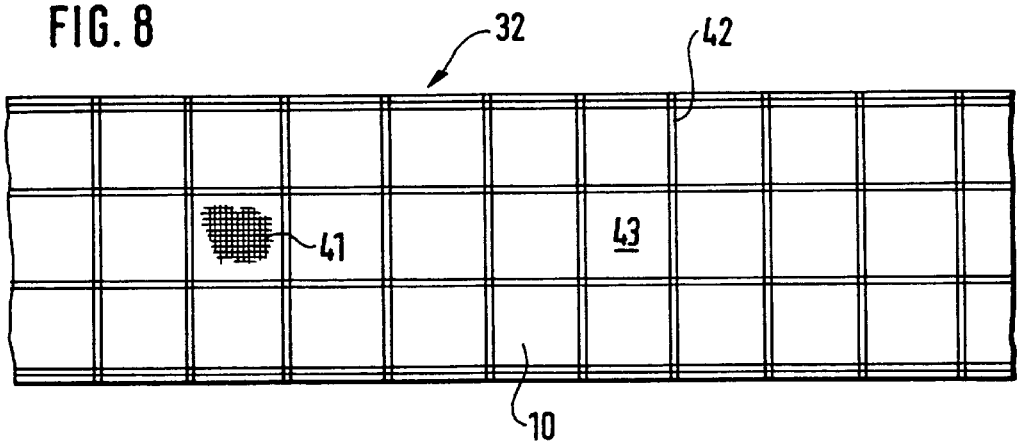

In conclusion, according to FIG. 8, the skeleton is refined in that smaller fields 43 are provided, which are defined by rougher double filaments 42. Inside the small fields 43, there is again the woven material made from a plurality of smaller filaments 41.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transport belt for transporting a fiber strand to be condensed through a condensing zone, comprising a perforation section for an air suction stream which suctions the fiber strand, wherein the perforation section is present in at least one of the areas which supports the fiber strand, said perforation section having at least 100 holes per square centimeter.

2. A transport belt according to claim 1, wherein the perforation section has at least 1000 holes per square centimeter.

3. A transport belt according to claim 2, wherein the transport belt consists of close perforated woven monofilaments.

4. A transport belt according to claim 3, wherein the transport belt is woven to a belt in a desired belt width and subsequently welded to form an endless belt.

5. A transport belt according to claim 4, wherein lateral edges are welded at the same time they are cut by means of a heated cutting tool.

6. A transport belt according to claim 2, wherein the transport belt is produced from an endless woven tube, which is then subsequently cut to a desired width.

7. A transport belt according to claim 2, wherein the transport belt is woven to a belt in a desired belt width and subsequently welded to form an endless belt.

8. A transport belt according to claim 2, wherein lateral edges are welded at the same time they are cut by means of a heated cutting tool.

9. A transport belt according to claim 8, wherein the transport belt is woven to a belt in a desired belt width and subsequently welded to form an endless belt.

10. A transport belt according to claim 1, wherein in the area of the perforation section a percentage of the area of holes of at least 40% is present.

11. A transport belt according to claim 1, wherein the transport belt is woven to a belt in a desired belt width and subsequently welded to form an endless belt.

12. A transport belt according to claim 1, wherein the transport belt consists of close perforated woven monofilaments.

13. A transport belt according to claim 12, wherein the transport belt is produced from an endless woven tube, which is then subsequently cut to a desired width.

14. A transport belt according to claim 12, wherein the transport belt is woven to a belt in a desired belt width and subsequently welded to form an endless belt.

15. A transport belt according to claim 12, wherein rougher filaments are woven in at certain intervals.

16. A transport belt according to claim 15, wherein lateral edges are welded at the same time they are cut by means of a heated cutting tool.

17. A transport belt according to claim 1, wherein the transport belt is produced from an endless woven tube, which is then subsequently cut to a desired width.

18. A transport belt according to claim 17, wherein lateral edges of the belt are reinforced by means of welding.

19. A transport belt according to claim 1, wherein the transport belt is woven to a belt in a desired belt width and subsequently welded to form an endless belt.

20. A transport belt according to claim 1, wherein the transport belt is cut out of a flat surface piece and subsequently welded to form an endless belt.

21. A transport belt according to claim 1, wherein the transport belt has a reinforcing skeleton.

22. A transport belt according to claim 21, wherein the transport belt is woven to a belt in a desired belt width and subsequently welded to form an endless belt.

23. A method of making a transport belt for transporting a fiber strand to be condensed over a suction area, said method comprising weaving a transport belt with a perforation pattern having at least 100 holes per square centimeter.

24. A method according to claim 23, wherein the transport belt is produced from an endless woven tube, which is then subsequently cut to the desired width.

25. A method according to claim 23, wherein the transport belt is woven to a belt in a desired belt width and subsequently welded to form an endless belt.

26. A method according to claim 23, wherein the transport belt is cut out of a flat surface piece and subsequently welded to form an endless belt.

27. A method according to claim 23, wherein lateral edges of the belt are reinforced by means of welding.

28. A method according to claim 23, wherein lateral edges are welded at the same time they are cut by means of a heated cutting tool.

29. A method according to claim 23, wherein the perforation pattern has at least 1000 holes per square centimeters.

30. A method according to claim 23, wherein the transport belt consists of close perforated woven monofilaments.

* * * * *